United States Patent [19]

Carey

[11] 4,411,110

[45] Oct. 25, 1983

[54] RAIN GUTTER

[76] Inventor: Robert J. Carey, 478 Leonardville Rd., P.O. Box 68, Belford, N.J. 00718

[21] Appl. No.: 319,385

[22] Filed: Nov. 9, 1981

[51] Int. Cl.[3] ..... E04D 13/06; E04D 13/08

[52] U.S. Cl. ..... 52/11; 52/12; 52/16

[58] Field of Search ..... 52/11-16, 52/95

[56] References Cited

U.S. PATENT DOCUMENTS

| | | | |
|---|---|---|---|
| 891,405 | 6/1908 | Cassens | 52/12 |
| 2,873,700 | 2/1959 | Heier | 52/12 |
| 3,080,682 | 3/1963 | Teutsch | 52/12 |
| 3,950,951 | 4/1976 | Zukauskas | 52/12 |

*Primary Examiner*—J. Karl Bell

*Attorney, Agent, or Firm*—R. Gale Rhodes, Jr.

[57] ABSTRACT

A generally closed longitudinally extending hollow rain gutter for preventing entrance thereinto of leaves and other debris which cause gutter clogging and the stoppage of rain flow into downspouts, the rain gutter includes a front provided with a plurality of rows of interrupted slots where the interruptions of the slots in each row are displaced horizontally with respect to the interruptions of the slots in the next adjacent row such that there is no path of rainflow down the front of the gutter which is not interrupted by at least one of the slots, the front is further provided with a plurality of inwardly and downwardly extending flaps formed along the top edges of the slots for receiving rain flowing across the front and for diverting the rain into the slots and into the hollow rain gutter.

9 Claims, 4 Drawing Figures

FIG. 2
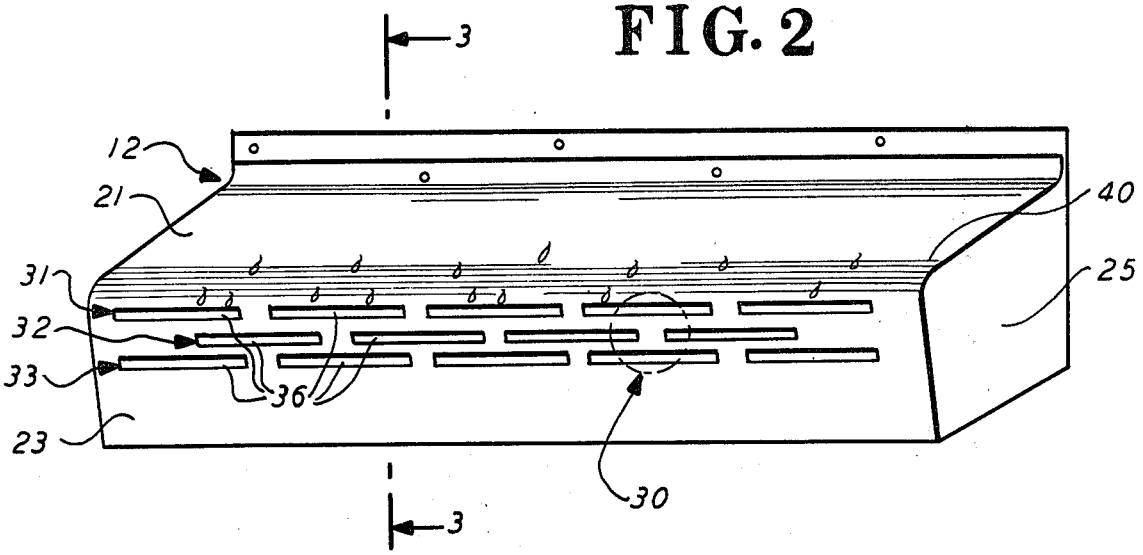
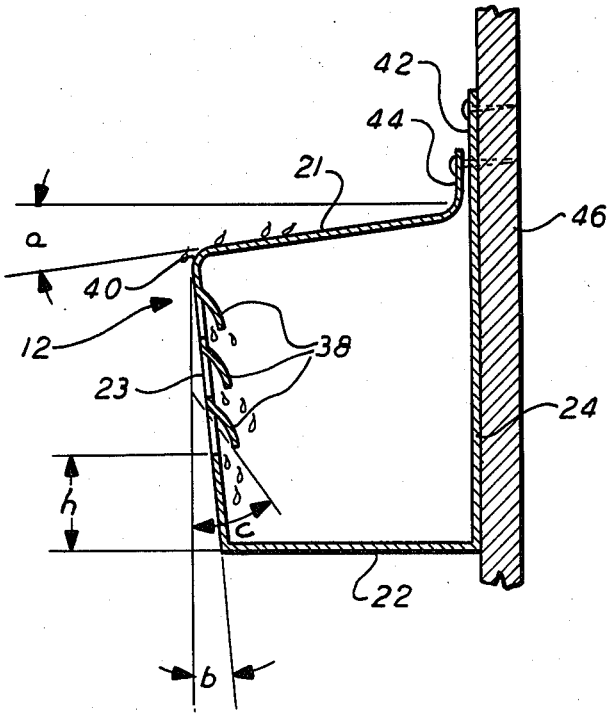
FIG. 3
FIG. 4
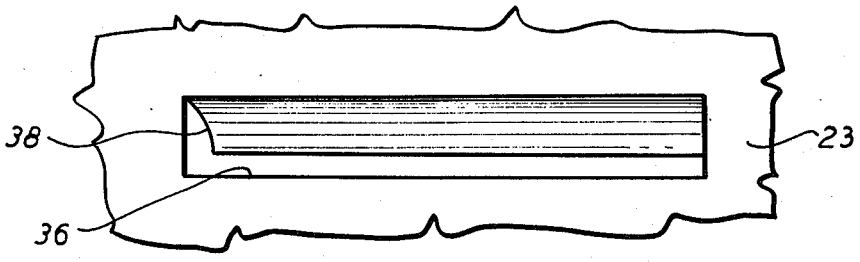

RAIN GUTTER

BACKGROUND OF THE INVENTION

This invention relates generally to rain gutters and in particular to an improved generally closed, hollow rain gutter for preventing entrance thereinto of leaves and other debris which cause rain gutter clogging and the stoppage of rain flow into downspouts.

As is known to those skilled in the rain gutter art, and as is particularly well known to home owners having trees in their yards close to their house, rain gutters are notorious for collecting leaves and other debris which clog the rain gutter and prevent rain flow into the downspouts whereby the rain gutter overflows and the rain falls down washing away soil from adjacent the house or other building and frequently washes away soil from plants or other shrubs adjacent the house or building.

As is further known to those skilled in the rain gutter art, the rain gutter art is replete with various structures to be added to the typical prior art rain gutter, open at the top, for preventing such leaves and other debris from collecting in the rain gutter; such other structures being typified by screen or other mesh material for being placed over the top of the open rain gutter to prevent the entrance of leaves and other debris. However, since such screen or mesh material is placed on the top of the open prior art rain gutter, leaves, or at least particles thereof, and other debris do enter through the openings in the screen and mesh material and, in time, do cause rain gutter clogging and prevention of rain flow through the downspouts.

Another problem associated with such prior art screen or mesh material is that it has sharp edges which can puncture and cut the hands of the person installing the screen or mesh material and, such mesh and screens are often damaged when removed. Further, upon the rain gutter being clogged underneath such installed screen and mesh material, it is extremely difficult, aggravating and annoying to have to frequently remove the screen or mesh material, clean the leaves and other debris out of the gutters, and then replace the screen or other mesh material.

Accordingly, there exists a need in the rain gutter art for an improved rain gutter which, upon being installed and as compared to the typical prior art rain gutter noted above, requires virtually no further maintenance, or at most very limited further maintenance, which virtually eliminates the need for constant cleaning and unclogging, and which provides substantially uninterrupted and unclogged flow therethrough of rain to the downspouts.

Accordingly, it is the object of the present invention to overcome the above-noted prior art rain gutter problem and to achieve the above-stated need.

SUMMARY OF THE INVENTION

The improved rain gutter of the present invention includes a generally closed longitudinally extending hollow rain gutter including a front provided with a plurality of longitudinally extending, generally horizontally disposed rows of interrupted slots where the interruptions of the slots in each row are displaced horizontally with respect to the interruptions of the slots in the next adjacent row such that there is no path of rainflow down the front which is not interrupted by at least one of the slots; the front is further provided with a plurality of generally inwardly and downwardly extending flaps provided along the top edge of the slots and which flaps receive rain flowing across the front and divert the rain into the slots and into the generally closed, hollow rain gutter.

DESCRIPTION OF THE DRAWINGS

FIG. 2 is a diagrammatic view, in perspective, of a rain gutter embodying the present invention;

FIG. 3 is a transverse, cross-sectional view taken substantially along the lines 3—3 in FIG. 2 in the direction of the arrows; and FIG. 4 is an enlarged partial view, in perspective, showing in greater detail a slot and flap of the present invention.

DESCRIPTION OF THE PREFERRED EMBODIMENT

Figure 1:
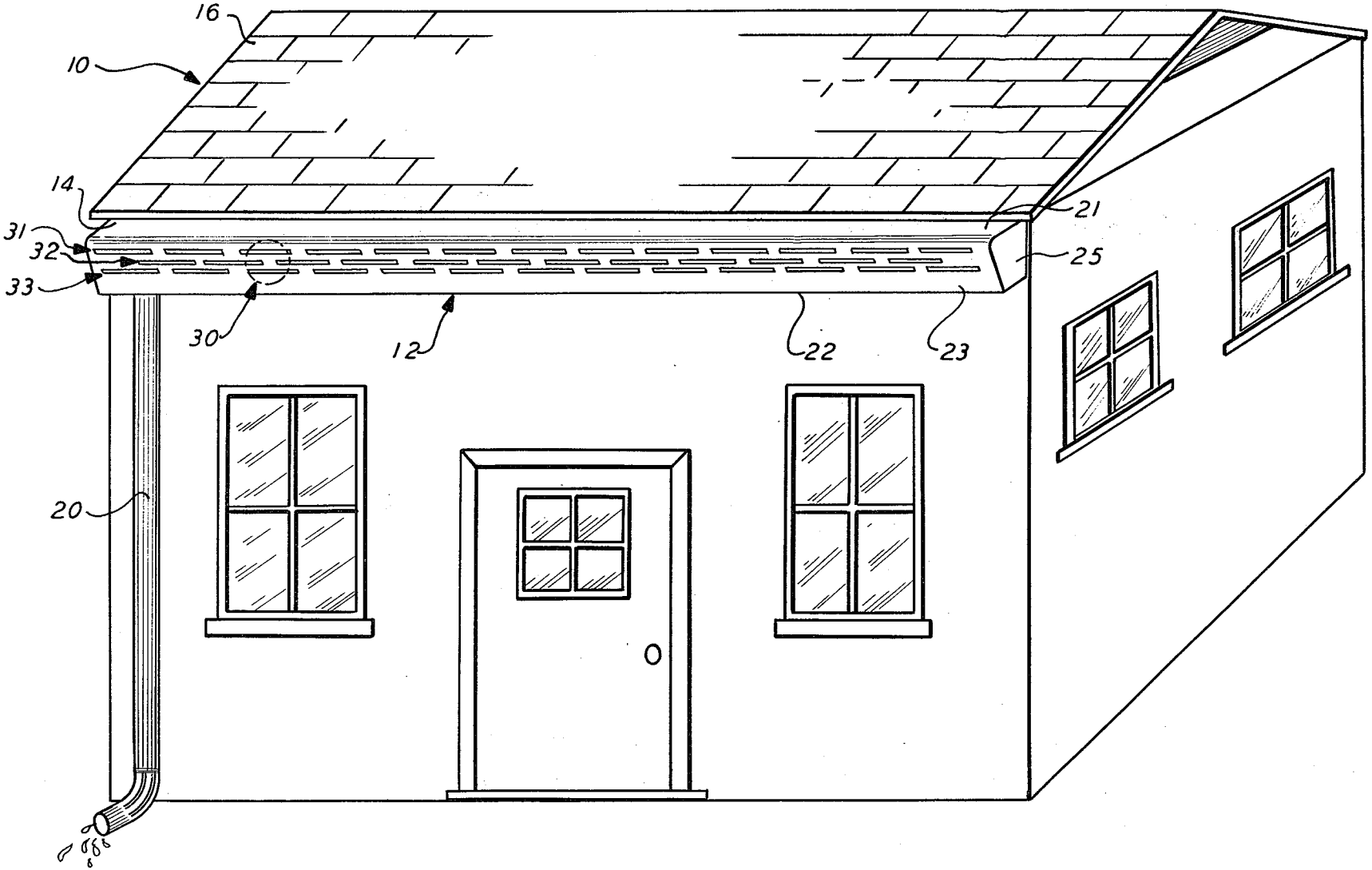
FIG. 1 is a diagrammatic view, in perspective, of a building provided with a rain gutter embodying the present invention.

Referring now to FIG. 1 there is shown a building or house 10 provided with a rain gutter 12 embodying the present invention. In the manner known to those skilled in the art, the rain gutter 12 is attached to the building 10 by suitable means, not shown, such that the rain gutter is adjacent and below the edge 14 of the roof 16. A downspout 20 may be provided and placed in communication with rain gutter 12 in the manner also known to those skilled in the rain gutter art.

Generally, the rain gutter 12 is of generally closed, longitudinally extending, hollow structure having a top 21, bottom 22, front 23, and back 24 (not shown) and a pair of closed ends 25. The front 23, as may be better seen in FIG. 2, is provided with a plurality of longitudinally extending, generally horizontally disposed, rows 31, 32 and 33 of interrupted slots 36, the interruptions between the slots 36 in each row are displaced horizontally with respect to the interruptions between the slots of the next adjacent row of slots such that there is no generally vertical path of rainflow down the front 23 which is not interrupted by at least one of the slots 36.

As may be best seen in FIG. 3, the top 21 is inclined at an angle a downwardly from the horizontal to enhance the flow of rain across the top 21 on to the front 23, and the front 23 is inclined inwardly at an angle b from the vertical to enhance the strength of the generally hollow rain gutter 12. As may also best be seen in FIG. 3, front 23 is provided with a plurality of generally inwardly and downwardly extending flaps 38 which flaps are provided along the top edges of the slots 36 and which flaps 38 are for receiving the rain (illustrated diagrammatically by the droplets shown) flowing down the front 23 and for directing or diverting the rain into the slots 36 and into the interior of the hollow rain gutter 12. To enhance such rain diverting, the flaps 38 may be inclined inwardly at an angle c from the vertical.

It will be understood by those skilled in the art that the slots 36 are of a predetermined size sufficiently small to generally prevent the entrance thereinto, and into the interior of the hollow rain gutter 12, of leaves, rocks, balls, birdnests, roof shingles, nails, chunks of slate roof, twigs, snow, squirrels, toys and other items thrown out of windows overlooking the rain gutter, and other debris.

It will be further understood by those skilled in the art that the top 21, bottom 22, and back 24 are closed, the ends are also closed, and that other than the rows of slots 31, 32 and 33 formed in the front 23, the front is also closed thereby providing the generally closed, longitudinally extending, hollow rain gutter 12.

Angles a, b and c of FIG. 3 may be preferably from 3° to 5° and the material of which the rain gutter 12 may be made is preferably aluminum or an aluminum alloy.

It will be still further understood by those skilled in the rain gutter art, and as may be best seen in FIG. 4 that the flaps 38 may be preferably formed integrally with the front 23 by stamping or die cutting the flaps out of the front and by bending the flaps generally inwardly and downwardly to the positions shown in FIG. 3. The slots 36 will then be formed or provided in the spaces in the front 23 where the flaps 38 have been pushed inwardly.

As shown in FIG. 3, the bottom row 33 of slots 36 is provided at a vertical distance h from the rain gutter bottom 22 to provide an internal trough through which the rain may flow to the downspout 20 (FIG. 1) without overflowing outwardly through the slots 36; preferably the vertical distance h is from 2 to 3 inches.

The top 21 and front 23 may intersect or merge into an outwardly rounded edge 40, as illustrated in FIGS. 2 and 3, which edge facilitates a smooth flow of the rain from the top onto the front.

As illustrated in FIG. 3, the improved rain gutter 12 may be provided with two upwardly extending collars 42 and 44, formed integrally respectively with the back 24 and top 21, which collars when closed together and fastened to the building 10 (FIG. 1) such as for example by the nails as shown, close the improved rain gutter and prevent rain from being blown behind the gutter which can cause a leak of rain to the ground below the rain gutter and rot the wood behind the gutter, e.g. facial board 46 of the building 10. It will be noted that upwardly extending collar 42 and lower upwardly extending collar 44 are independently secured to the facial board 46, such as by the nails as shown. Hence, if desired, or if it becomes necessary, the upwardly extending collar 42 may remain secured to the building or facial board 46 while only the nails securing the lower upwardly extending collar 44 are removed to permit opening of the improved rain gutter 12 without removal of the rain gutter completely from the facial board 46 and hence the building 10. Also, it will be understood that the double or dual upwardly extending collars 42 and 44 permit the installer versatility in the installation of the improved rain gutter 12 which is useful since there are many different types of buildings or houses to which rain gutters are attached.

As to manufacture of the improved rain gutter 12, it will be understood by those skilled in the art that the top, bottom, front and back of the gutter may be made from separate pieces of material, suitably shaped and joined in the manner known to those skilled in the art, or the top, front, bottom, back and integrally formed collars 42 and 44, may be formed from a single piece of material, suitably shaped as shown in cross-section in FIG. 3 by means well-known to those skilled in the art, and the end pieces joined in the manner also known to those skilled in the art.

It will be understood by those skilled in the art that many modifications and variations of the present invention may be made without departing from the spirit and the scope thereof.

What is claimed is:

1. An improved rain gutter for preventing entrance thereinto of leaves and other debris which cause rain gutter clogging and the stoppage of rain flow into downspouts, the improved rain gutter for being attached to a building adjacent the edge of a roof upon which rain falls, comprising:

generally closed longitudinally extending hollow rain gutter means including a front;

said front provided with a plurality of longitudinally extending, generally horizontally disposed, rows of interrupted slots, the interruptions between the slots in each row being displaced horizontally with respect to the interruptions between the slots of the next adjacent row of slots such that there is no generally vertical path of rainflow down said front which is not interrupted by at least one of said slots;

said front provided with a plurality of generally inwardly and downwardly extending flaps;

said flaps provided along the top edges of said slots for receiving rain flowing across said front and for diverting said rain into said hollow rain gutter means; and said slots being of a predetermined size sufficiently small to generally prevent the entrance thereinto, and into said hollow rain gutter means, of said leaves and other debris.

2. An improved rain gutter for preventing entrance thereinto of leaves and other debris which cause rain gutter clogging and the stoppage of rain flow into downspouts, the improved rain gutter for being attached to a building adjacent the edge of a roof upon which rain falls and for being connected to said downspouts, comprising:

generally closed longitudinally extending hollow rain gutter means of a predetermined material and having a top, bottom, front, back and a pair of ends;

said top being inclined at a first predetermined angle downwardly from the horizontal to enhance the flow of said rain thereacross and to said front;

said front being inclined at a second predetermined angle inwardly from the vertical to enhance the strength of said hollow rain gutter means and being provided with a plurality of longitudinally extending, generally horizontally disposed, rows of interrupted slots, the interruptions between the slots in each row being displaced horizontally with respect to the interruptions between the slots of the next adjacent row of slots such that there is no generally vertical path of rainflow down said front which is not interrupted by at least one of said slots and, said front provided with a plurality of generally inwardly and downwardly extending flaps;

said flaps provided along the top edges of said slots and for receiving rain flowing down said front and for diverting said rain into said hollow rain gutter means;

said slots being of a predetermined size sufficiently small to generally prevent the entrance thereinto, and into said hollow rain gutter means, of said leaves and other debris; and said top, back and ends being closed to prevent passage therethrough of said leaves and other debris, and said bottom being closed other than where said downspouts are placed in communication therewith.

3. An improved rain gutter according to claim 2 wherein said hollow rain gutter means is of generally trapezoidal, transverse configuration.

4. An improved rain gutter according to claim 2 wherein said predetermined material is a predetermined aluminum or aluminum alloy.

5. An improved rain gutter in accordance with claim 2 wherein said flaps are formed integrally with said front by stamping or die cutting said flaps out of said front and by bending said flaps generally inwardly and downwardly, and wherein said slots are formed in the spaces in said front where said flaps have been pushed inwardly.

6. An improved rain gutter according to claim 2 wherein said first and second predetermined angles are substantially from 3° to 5°.

7. An improved rain gutter according to claim 2 wherein said top and front merge into an outwardly rounded edge which edge facilitates a smooth flow of said rain from said top onto said front.

8. An improved rain gutter according to claim 2 wherein there is a predetermined vertical distance between the bottom row of said interrupted slots and said rain gutter bottom, said predetermined vertical distance providing a trough internally of said rain gutter through which said rain can flow to said downspouts without overflowing outwardly through said slots.

9. An improved rain gutter according to claim 8 wherein said predetermined height is from 2 to 3 inches.

* * * * *

US004411110C1

(12) EX PARTE REEXAMINATION CERTIFICATE (5008th)

United States Patent
Carey

(10) Number: US 4,411,110 C1
(45) Certificate Issued: Nov. 2, 2004

(54) RAIN GUTTER

(75) Inventor: Robert J. Carey, 478 Leonardville Rd., P.O. Box 68, Belford, NJ (US) 00718

(73) Assignee: Robert J. Carey, Belford, NJ (US)

Reexamination Request:
No. 90/006,219, Feb. 15, 2002

Reexamination Certificate for:

| | |
|---|---|
| Patent No.: | **4,411,110** |
| Issued: | **Oct. 25, 1983** |
| Appl. No.: | **06/319,385** |
| Filed: | **Nov. 9, 1981** |

(51) Int. Cl.[7] ..... E04D 13/076; E04D 13/08
(52) U.S. Cl. ..... 52/11; 52/12; 52/16
(58) Field of Search ..... 52/12

(56) References Cited

U.S. PATENT DOCUMENTS

| | | | | |
|---|---|---|---|---|
| 471,427 | A | | 3/1892 | Lavallet |
| 550,173 | A | | 11/1895 | Hitt |
| 691,744 | A | | 1/1902 | Carr |
| 706,333 | A | | 8/1902 | Meuser |
| 803,670 | A | * | 11/1905 | Crawford |
| 891,405 | A | | 6/1908 | Cassens |
| 1,226,712 | A | | 5/1917 | Skillman |
| 2,120,395 | A | | 6/1938 | Dean |
| 2,271,081 | A | * | 1/1942 | Layton |
| 2,461,610 | A | | 2/1949 | Lord |
| 2,873,700 | A | | 2/1959 | Heier |
| 2,988,226 | A | | 6/1961 | Campbell |
| 3,023,544 | A | | 3/1962 | Hughes |
| 3,080,682 | A | | 3/1963 | Teutsch |
| 3,388,555 | A | | 6/1968 | Foster |
| 3,950,951 | A | | 4/1976 | Zukauskas |
| 4,404,775 | A | | 9/1983 | Demartini |
| 4,435,925 | A | | 3/1984 | Jefferys |

* cited by examiner

*Primary Examiner*—Robert Canfield

(57) ABSTRACT

A generally closed longitudinally extending hollow rain gutter for preventing entrance thereinto of leaves and other debris which cause gutter clogging and the stoppage of rain flow into downspouts, the rain gutter includes a front provided with a plurality of rows of interrupted slots where the interruptions of the slots in each row are displaced horizontally with respect to the interruptions of the slots in the next adjacent row such that there is no path of rainflow down the front of the gutter which is not interrupted by at least one of the slots, the front is further provided with a plurality of inwardly and downwardly extending flaps formed along the top edges of the slots for receiving rain flowing across the front and for diverting the rain into the slots and into the hollow rain gutter.

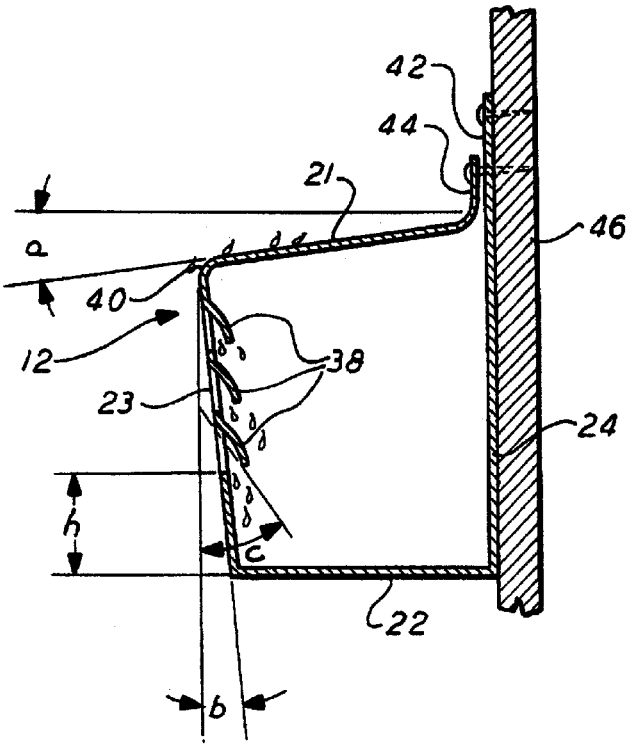

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–9 is confirmed.

Claim 1 is cancelled.

* * * * *